US007859358B2

(12) United States Patent
Kitamori et al.

(10) Patent No.: US 7,859,358 B2
(45) Date of Patent: Dec. 28, 2010

(54) NON-RECIPROCAL CIRCUIT DEVICE

(75) Inventors: Nobumasa Kitamori, Komatsu (JP); Takashi Hasegawa, Oumihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/758,822

(22) Filed: Apr. 13, 2010

(65) Prior Publication Data

US 2010/0188161 A1 Jul. 29, 2010

Related U.S. Application Data

(63) Continuation of application No. PCT/JP2008/066045, filed on Sep. 5, 2008.

(30) Foreign Application Priority Data

Nov. 29, 2007 (JP) ..... 2007-308997

(51) Int. Cl.
*H01P 1/36* (2006.01)

(52) U.S. Cl. ..... 333/24.2; 333/1.1

(58) Field of Classification Search ..... 333/24.2, 333/1.1

See application file for complete search history.

(56) References Cited

U.S. PATENT DOCUMENTS

2009/0003944 A1 1/2009 Omori et al.

FOREIGN PATENT DOCUMENTS

| | | | |
|---|---|---|---|
| JP | 63-081403 | U | 5/1988 |
| JP | 10-004301 | A | 1/1998 |
| JP | 2007-306149 | A | 11/2007 |
| WO | 2007/046299 | A1 | 4/2007 |

OTHER PUBLICATIONS

Official Communication issued in International Patent Application No. PCT/JP2008/066045, mailed on Dec. 16, 2008.

*Primary Examiner*—Stephen E Jones
(74) *Attorney, Agent, or Firm*—Keating & Bennett, LLP

(57) ABSTRACT

A nonreciprocal circuit device has a structure that allows a direct current magnetic field having an even density to be applied to a necessary portion of a ferrite without impairing a reduction in profile so as to improve insertion loss. The non-reciprocal circuit device, for example, a two-port isolator, includes permanent magnets, a ferrite to which a direct current magnetic field is applied by the permanent magnets, and a first center electrode and a second center electrode that are disposed on the ferrite. The permanent magnets are disposed so as to oppose principal surfaces of the ferrite. Portions of each of the permanent magnets opposing relay electrodes on top and bottom surfaces are preferably thicker than other portions thereof.

9 Claims, 7 Drawing Sheets

NON-RECIPROCAL CIRCUIT DEVICE

BACKGROUND OF THE INVENTION

1. Field of the Invention

The present invention relates to nonreciprocal circuit devices, and in particular, relates to a nonreciprocal circuit device such as an isolator and a circulator used in a microwave band.

2. Description of the Related Art

Conventional nonreciprocal circuit devices such as isolators and circulators have had characteristics that transmit signals only in a predetermined specific direction and do not transmit signals in the opposite direction. For example, isolators are used in transmitter circuits in mobile communication equipment such as car phones and cellular phones, using the characteristics described above.

A nonreciprocal circuit device of such a type includes an assembly that includes a ferrite in which center electrodes are provided and permanent magnets that apply a direct current magnetic field to the ferrite. An improvement in electric characteristics, a reduction in size, especially, a reduction in profile, and the like are required.

International Publication No. 2007/046299 describes a nonreciprocal circuit device in which a ferrite in which a first center electrode and a second center electrode are provided and permanent magnets are disposed so as to have a shape that has front and back rectangular principal surfaces of the same size, the respective principal surfaces opposing each other so that the respective outer shapes coincide with each other.

However, when the respective outer shapes of the respective principal surfaces of a ferrite 32 and permanent magnets 41 are the same, as shown in FIG. 13A, since leakage flux $\phi$3 occurs at ends, magnetic flux $\phi$2 at the ends is smaller than magnetic flux $\phi$1 at the center. This arrangement has a problem in that the density of magnetic flux applied to the principal surfaces of the ferrite 32 becomes uneven, and thus the insertion loss decreases.

In order to improve the condition, the outer shape of the permanent magnets 41 may be enlarged, as shown in FIG. 13B. In this case, even when the leakage flux $\phi$3 occurs, the magnetic flux $\phi$2 applied to the ends of the ferrite 32 is substantially equivalent to the magnetic flux $\phi$1 at the center. However, in this remedy, since the permanent magnets 41 become larger, the size of the nonreciprocal circuit device is increased. In particular, a reduction in profile is greatly impaired.

SUMMARY OF THE INVENTION

Preferred embodiments of the present invention provide a nonreciprocal circuit device in which a direct current magnetic field having an even density can be applied to a necessary portion of a ferrite without impairing a reduction in profile, and thus insertion loss can be improved.

A nonreciprocal circuit device according to a preferred embodiment of the present invention includes permanent magnets, a ferrite having a rectangular parallelepiped plate shape including two principal surfaces opposite to each other, the permanent magnets being arranged to apply to the ferrite a direct current magnetic field that penetrates the principal surfaces, and a first center electrode and a second center electrode that are disposed on the ferrite, the first center electrode and the second center electrode being electrically insulated from each other and intersecting with each other.

The ferrite and the permanent magnets constitute a ferrite-magnet assembly in which the permanent magnets are disposed so as to oppose the principal surfaces of the ferrite, the first center electrode and the second center electrode are disposed on the principal surfaces of the ferrite and are wound around the ferrite via relay electrodes provided on side surfaces disposed on long sides, the side surfaces being perpendicular or substantially perpendicular to the principal surfaces, and each of the permanent magnets includes a principal surface that has the same shape as the principal surfaces of the ferrite, and portions of the permanent magnet opposing the relay electrodes are preferably thicker than the other portion.

In the nonreciprocal circuit device, each of the permanent magnets sandwiching the ferrite includes a principal surface that has the same shape as the principal surfaces of the ferrite, and portions of the permanent magnet opposing the relay electrodes for the first and second center electrodes disposed on the ferrite (side surfaces disposed on long sides, the side surfaces being perpendicular or substantially perpendicular to the principal surfaces of the ferrite) are preferably thicker than the other portion. Thus, large magnetic flux is produced at ends of the ferrite, and even when leakage flux occurs, a direct current magnetic field having magnetic flux density that is substantially equivalent to that at the center portion of the ferrite is applied to the ends of the ferrite. Thus, a direct current magnetic field having an even density can be applied to a necessary portion of the ferrite without impairing a reduction in the profile of the nonreciprocal circuit device, and thus insertion loss is improved.

According to a preferred embodiment of the present invention, since a permanent magnet includes a principal surface that has the same shape as a principal surface of a ferrite, and portions of the permanent magnet opposing relay electrodes disposed on the ferrite are preferably thicker than the other portion, a direct current magnetic field having an even density can be applied to a necessary portion of the ferrite without impairing a reduction in profile, and thus insertion loss can be improved.

Other elements, features, steps, characteristics and advantages of the present invention will become more apparent from the following detailed description of the preferred embodiments with reference to the attached drawings.

BRIEF DESCRIPTION OF THE DRAWINGS

FIGS. 13A-13C are illustrations showing the thickness of a permanent magnet, wherein FIG. 13A shows a known art, FIG. 13B shows a comparative example, and FIG. 13C shows a preferred embodiment of the present invention.

DETAILED DESCRIPTION OF THE PREFERRED EMBODIMENTS

Preferred embodiments of a nonreciprocal circuit device according to the present invention will now be described with reference to the attached drawings.

Figure 1:
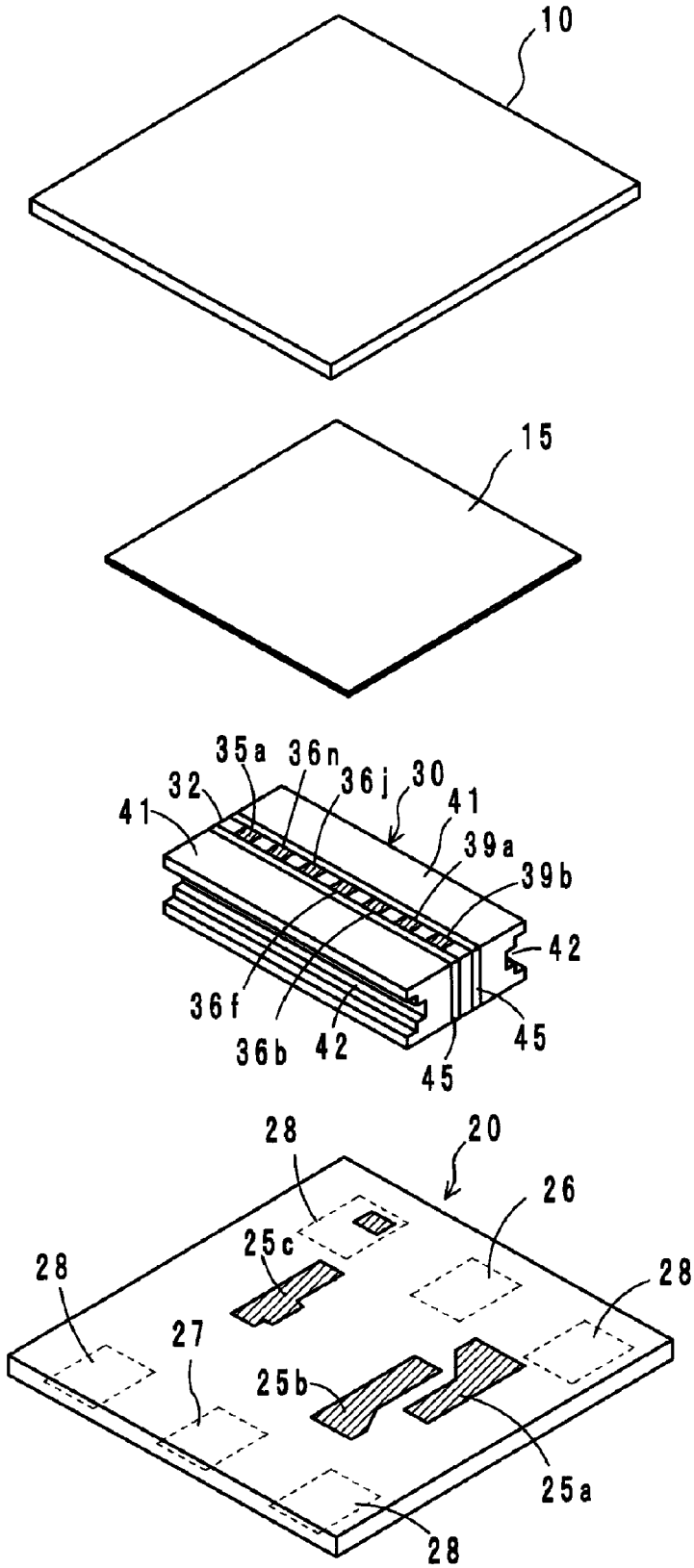
FIG. 1 is an exploded perspective view showing a preferred embodiment of a nonreciprocal circuit device (a two-port isolator) according to the present invention.

An exploded perspective view of a two-port isolator according to a preferred embodiment of the nonreciprocal circuit device according to the present invention is shown in FIG. 1. The two-port isolator is a lumped constant isolator and preferably includes a planar yoke 10, a circuit board 20, and a ferrite-magnet assembly 30 that includes a ferrite 32 and a pair of permanent magnets 41. In FIG. 1, shaded portions indicate electrical conductors.

Figure 2:
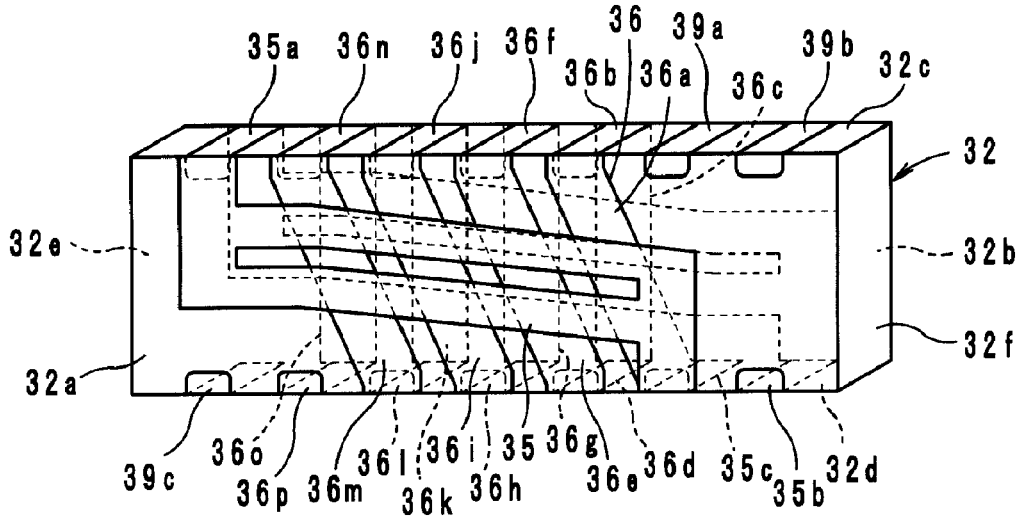
FIG. 2 is a perspective view showing a ferrite provided with center electrodes.

In the ferrite 32, a first center electrode 35 and a second center electrode 36 electrically insulated from each other are provided on front and back principal surfaces 32*a* and 32*b*, as shown in FIG. 2. The ferrite 32 preferably has a rectangular parallelepiped shape that includes the first principal surface 32*a* and the second principal surface 32*b* parallel or substantially parallel to each other and includes a top surface 32*c*, a bottom surface 32*d*, and end surfaces 32*e* and 32*f* that are perpendicular or substantially perpendicular to the principal surfaces 32*a* and 32*b*.

Moreover, the permanent magnets 41 are bonded to the principal surfaces 32*a* and 32*b* of the ferrite 32 via, for example, epoxy adhesives 45 so as to apply a magnetic field to the principal surfaces 32*a* and 32*b* in a direction substantially perpendicular to the principal surfaces 32*a* and 32*b* (refer to FIG. 4) to form the ferrite-magnet assembly 30. A principal surface 41*a* of each of the permanent magnets 41 preferably has the same size as the principal surfaces 32*a* and 32*b* of the ferrite 32. The permanent magnets 41 and the ferrite 32 are disposed so that the principal surfaces 32*a* and 41*a* oppose each other and the principal surfaces 32*b* and 41*a* oppose each other so that the respective outer shapes coincide with each other.

The first center electrode 35 is arranged so as to extend on the first principal surface 32*a* of the ferrite 32 from the lower right toward the upper left, the first center electrode 35 bifurcating into two parts, to define a relatively small angle with a long side at the upper left, as shown in FIG. 2. Then, the first center electrode 35 comes to the second principal surface 32*b* via a relay electrode 35*a* on the top surface 32*c*. On the second principal surface 32*b*, the first center electrode 35 is arranged to be bifurcated into two parts so as to overlap the first principal surface 32*a*, when viewed in perspective, and one end of the first center electrode 35 is connected to a connection electrode 35*b* provided on the bottom surface 32*d*. Moreover, the other end of the first center electrode 35 is connected to a connection electrode 35*c* provided on the bottom surface 32*d*. In this manner, a turn of the first center electrode 35 is wound around the ferrite 32. The first center electrode 35 and the second center electrode 36 described below intersect with each other, with being insulated from each other, an insulating film being formed between the first center electrode 35 and the second center electrode 36.

A 0.5th turn 36*a* of the second center electrode 36 is first arranged so as to extend on the first principal surface 32*a* from the lower right toward the upper left, the second center electrode 36 intersecting with the first center electrode 35, to defined a relatively large angle with the long side. Then, the second center electrode 36 comes to the second principal surface 32*b* via a relay electrode 36*b* on the top surface 32*c*. On the second principal surface 32*b*, a first turn 36*c* of the second center electrode 36 is arranged to intersect with the first center electrode 35 substantially at right angles. The lower end of the first turn 36*c* extends to the first principal surface 32*a* via a relay electrode 36*d* on the bottom surface 32*d*. On the first principal surface 32*a*, a 1.5th turn 36*e* of the second center electrode 36 is arranged to intersect with the first center electrode 35 and to extend in parallel or substantially in parallel with the 0.5th turn 36*a*. Then, the second center electrode 36 comes to the second principal surface 32*b* via a relay electrode 36*f* on the top surface 32*c*. Similarly, a second turn 36*g*, a relay electrode 36*h*, a 2.5th turn 36*i*, a relay electrode 36*j*, a third turn 36*k*, a relay electrode 36*l*, a 3.5th turn 36*m*, a relay electrode 36*n*, and a fourth turn 36*o* are provided on the surfaces of the ferrite 32. Moreover, the both ends of the second center electrode 36 are connected to the connection electrode 35*c* and a connection electrode 36*p* provided on the bottom surface 32*d* of the ferrite 32, respectively. In this case, the connection electrode 35*c* is shared as a connection electrode for one end of each of the first center electrode 35 and the second center electrode 36.

Four turns of the second center electrode 36 are helically wound around the ferrite 32. In this case, the number of turns is calculated, assuming that a state in which the second center electrode 36 crosses the first principal surface 32*a* or the second principal surface 32*b* once corresponds to 0.5 turn. A crossing angle between the center electrodes 35 and 36 is set appropriately so as to adjust input impedance, insertion loss, and the like.

Figure 3:
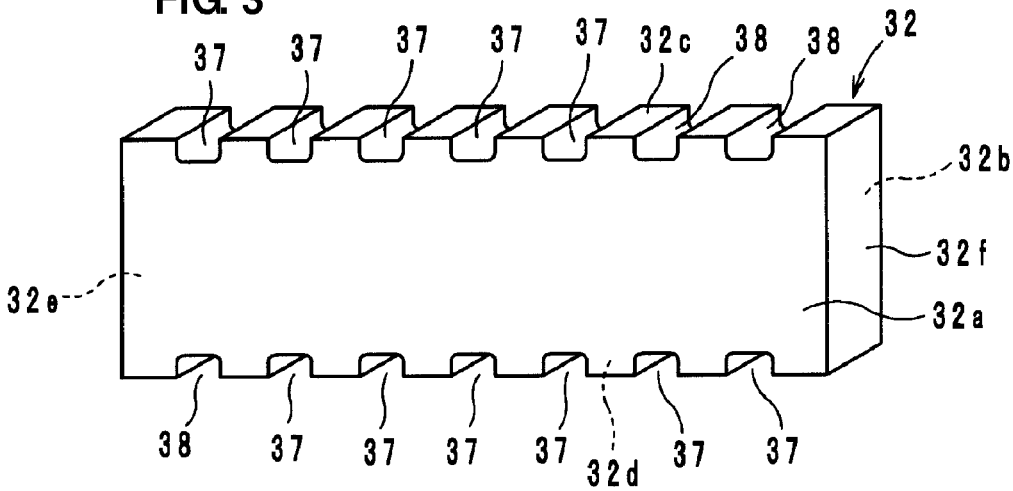
FIG. 3 is a perspective view showing the ferrite, in which the electrodes have not been formed.

Moreover, the connection electrodes 35*b*, 35*c*, and 36*p* and the relay electrodes 35*a*, 36*b*, 36*d*, 36*f*, 36*h*, 36*j*, 36*l*, and 36*n* are formed by applying or filling electrical conductive materials for electrodes, such as silver, silver alloy, copper, or copper alloy, to or into depressions 37 (refer to FIG. 3) provided on the top and bottom surfaces 32*c* and 32*d* of the ferrite 32. Moreover, dummy depressions 38 are also formed on the top and bottom surfaces 32*c* and 32*d*, extending in parallel or substantially in parallel with various electrodes, and dummy electrodes 39*a*, 39*b*, and 39*c* are formed in the dummy depressions 38. An electrode of this type is preferably formed by forming a through hole in a mother ferrite board in advance, filling the through hole with electrical conductive materials for electrodes, and then cutting the through hole at a position to be cut. In this case, various electrodes may be formed in the depressions 37 and 38 as conductor films.

For example, YIG ferrite is preferably used as the ferrite 32. The first and second center electrodes 35 and 36 and various electrodes may be formed as thick films or thin films of, for example, silver or silver alloy, using production techniques such as printing, transfer, or photolithography. For example, a dielectric thick film, such as glass or alumina, or a resin film, such as polyimide, may be used as the insulating film for the center electrodes 35 and 36. They may be also formed, using production techniques such as printing, transfer, or photolithography.

In general, strontium ferrite magnets, barium ferrite magnets, or lanthanum cobalt ferrite magnets are preferably used as the permanent magnets 41. One-part heat curable epoxy adhesives are optimally used as the adhesives 45 for bonding the permanent magnets 41 to the ferrite 32.

Figure 4:
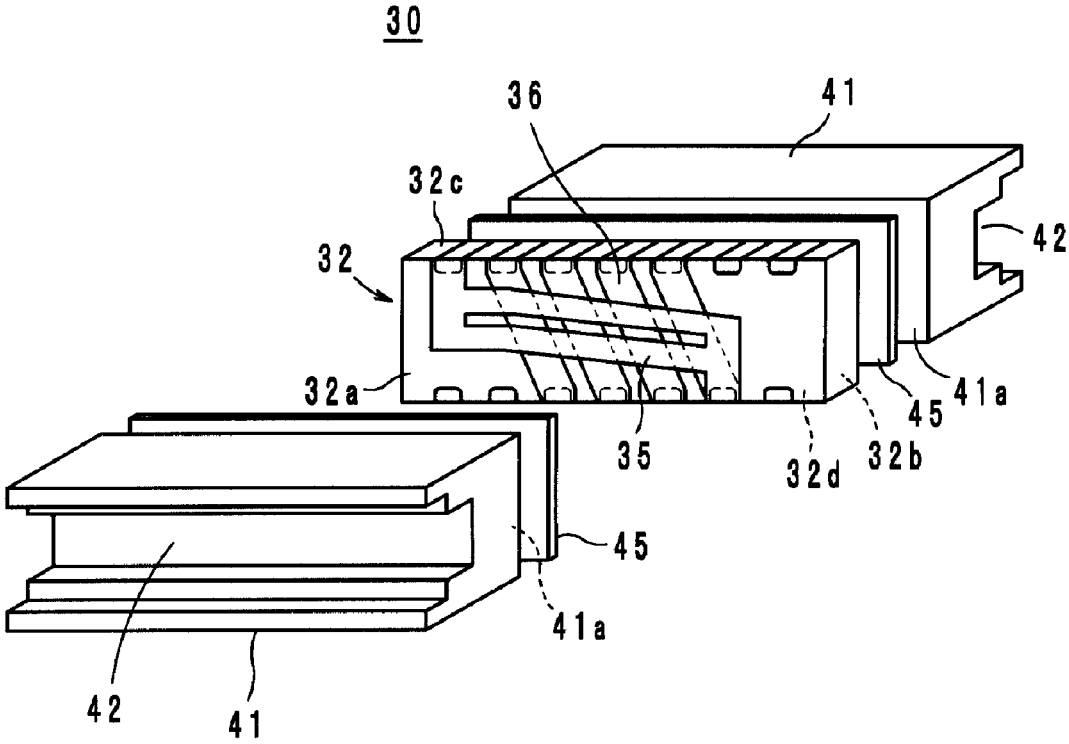
FIG. 4 is an exploded perspective view showing a ferrite-magnet assembly.

In the present preferred embodiment, the principal surface 41*a* of each of the permanent magnets 41 preferably has the same shape as the principal surfaces 32*a* and 32*b* of the ferrite 32, and portions of the permanent magnets 41 opposing the relay electrodes 35*a*, 36*b*, 36*d*, 36*f*, 36*h*, 36*j*, 36*l*, and 36*n*, i.e., portions of the permanent magnets 41 opposing the top side portion and bottom side portion of the ferrite 32, are preferably thicker than the other portions of the permanent magnets 41. Specifically, a depression 42 having a staircase-shaped cross section is formed on a surface opposite the principal surface 41*a* of each of the permanent magnets 41 by cutting or presswork, for example, as shown in FIG. 4. Advantageous effects achieved by changing the thickness of the permanent magnets 41 will be described below in detail.

Figure 5:
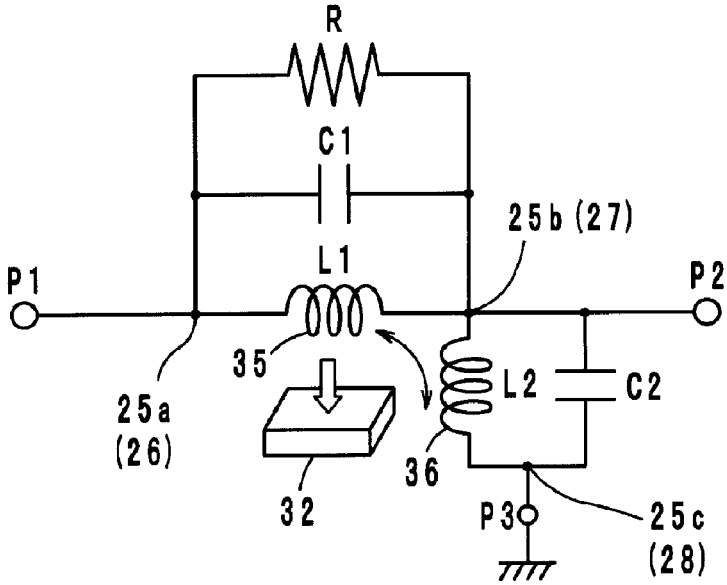
FIG. 5 is an equivalent circuit diagram showing a first exemplary circuit of a two-port isolator.
Figure 6:
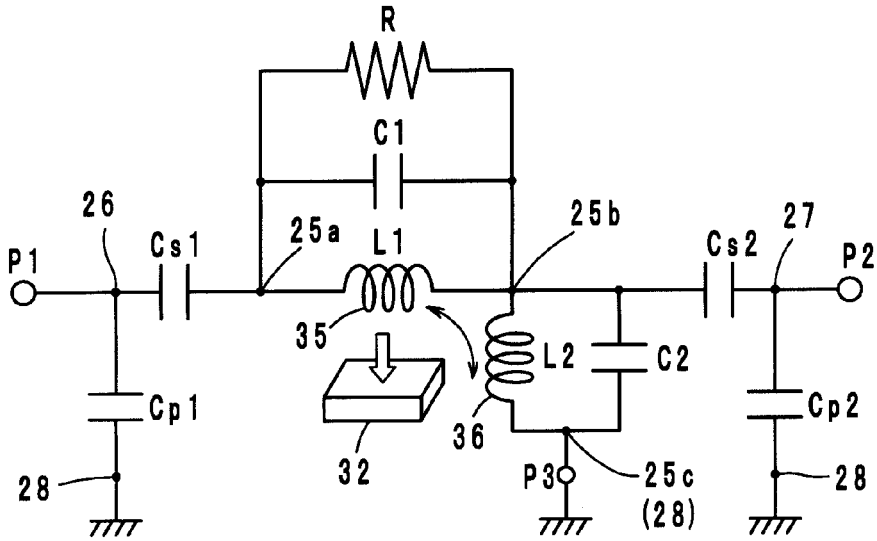
FIG. 6 is an equivalent circuit diagram showing a second exemplary circuit of a two-port isolator.

The circuit board 20 preferably is a laminated board obtained by laminating and sintering a plurality of dielectric sheets on which predetermined electrodes are formed. In the circuit board 20, matching capacitors C1, C2, Cs1, Cs2, Cp1, and Cp2 and a termination resistor R are provided, as shown in FIGS. 5 and 6 showing equivalent circuits. Moreover, terminal electrodes 25*a*, 25*b*, and 25*c* are provided on the top surface of the circuit board 20, and external connection terminal electrodes 26, 27, and 28 are provided on the bottom surface of the circuit board 20.

For example, connections between these matching circuit elements and the first and second center electrodes 35 and 36 are as described in FIG. 5 showing a first exemplary circuit and FIG. 6 showing a second exemplary circuit. The connections will now be described on the basis of the second exemplary circuit shown in FIG. 6.

The external connection terminal electrode 26 provided on the bottom surface of the circuit board 20 functions as an input port P1. The terminal electrode 26 is connected to the matching capacitor C1 and the termination resistor R via the matching capacitor Cs1. Moreover, the electrode 26 is connected to one end of the first center electrode 35 via the terminal electrode 25*a* provided on the top surface of the circuit board 20 and the connection electrode 35*b* provided on the bottom surface 32*d* of the ferrite 32.

The other end of the first center electrode 35 and one end of the second center electrode 36 are connected to the termination resistor R and the capacitors C1 and C2 via the connection electrode 35*c* provided on the bottom surface 32*d* of the ferrite 32 and the terminal electrode 25*b* provided on the top surface of the circuit board 20 and are connected to the external connection terminal electrode 27 provided on the bottom surface of the circuit board 20 via the capacitor Cs2. The electrode 27 functions as an output port P2.

The other end of the second center electrode 36 is connected to the capacitor C2 and the external connection terminal electrodes 28 provided on the bottom surface of the circuit board 20 via the connection electrode 36*p* provided on the bottom surface 32*d* of the ferrite 32 and the terminal electrode 25*c* provided on the top surface of the circuit board 20. The electrodes 28 function as a ground port P3.

Moreover, the impedance adjusting capacitor Cp1 that is grounded is connected to a junction point of the input port P1 and the capacitor Cs1. Similarly, the impedance adjusting capacitor Cp2 that is grounded is connected to a junction point of the output port P2 and the capacitor Cs2.

The ferrite-magnet assembly 30 is placed on the circuit board 20, various electrodes on the bottom surface 32*d* of the ferrite 32 are integrated with the terminal electrodes 25*a*, 25*b*, and 25*c* on the circuit board 20 by reflow soldering, and the respective bottom surfaces of the permanent magnets 41 are integrated with the circuit board 20, using adhesives, for example. Moreover, a surrounding area of the ferrite-magnet assembly 30 is filled with resin materials (not shown).

The planar yoke 10 has an electromagnetic shielding function and is fixed to the top surface of the ferrite-magnet assembly 30 with a dielectric layer (an adhesive layer) 15 between the planar yoke 10 and the ferrite-magnet assembly 30. Functions of the planar yoke 10 include suppressing magnetic leakage and high frequency field leakage from the ferrite-magnet assembly 30, suppressing external magnetic influence, and providing a place for pickup using a vacuum nozzle when this isolator is mounted on a board (not shown) using a chip mounter. The planar yoke 10 need not necessarily be grounded. However, the planar yoke 10 may be grounded by soldering or using an electrically conductive adhesive, for example. When the planar yoke 10 is grounded, the effect of high frequency shielding is improved.

In the two-port isolator including the aforementioned components, the one end of the first center electrode 35 is connected to the input port P1, the other end of the first center electrode 35 is connected to the output port P2, the one end of the second center electrode 36 is connected to the output port P2, and the other end of the second center electrode 36 is connected to the ground port P3. Thus, a lumped constant isolator of a two-port type in which insertion loss is small can be implemented. Moreover, during operation, a large high frequency current runs through the second center electrode 36, and a little high frequency current runs through the first center electrode 35. Thus, the direction of a high frequency field produced by the first center electrode 35 and the second center electrode 36 is determined by the placement of the second center electrode 36. When the direction of the high frequency field is determined, measures for decreasing insertion loss are facilitated.

Figure 7A:
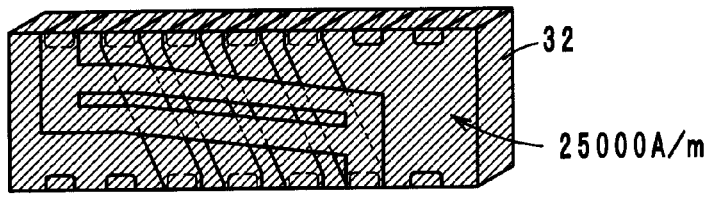
FIGS. 7A-7C are illustrations showing three types of models of the distribution of a direct current magnetic field applied to the ferrite.
Figure 13A:
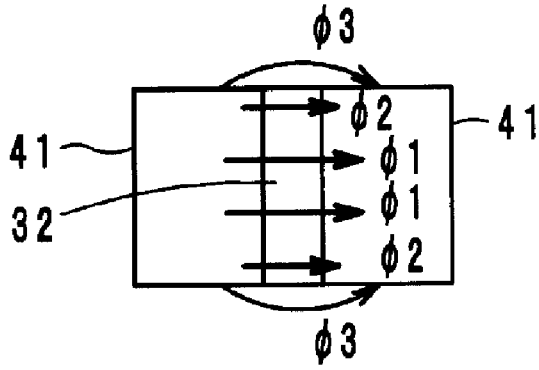
FIG. 13A Prior Art

The relationship between the distribution of a direct current magnetic field applied to the ferrite 32 by the permanent magnets 41 and insertion loss will now be described on the basis of simulations performed by the inventors. When a magnetic field of 25000 A/m, for example, is applied to the entire surfaces of the ferrite 32, as shown in FIG. 7A, satisfactory insertion loss characteristics indicated by a solid line A in FIG. 8 are achieved. On the other hand, when a magnetic field of 25000 A/m, for example, is applied to the center portion of the ferrite 32 in the short side direction, and a magnetic field of 20000 A/m, for example, is applied to the top and bottom ends of the ferrite 32, as shown in FIG. 7B (corresponding to the known art shown in FIG. 13A), insertion loss characteristics indicated by a long dash line B in FIG. 8 are achieved, and the characteristics deteriorate.

Figure 13B:
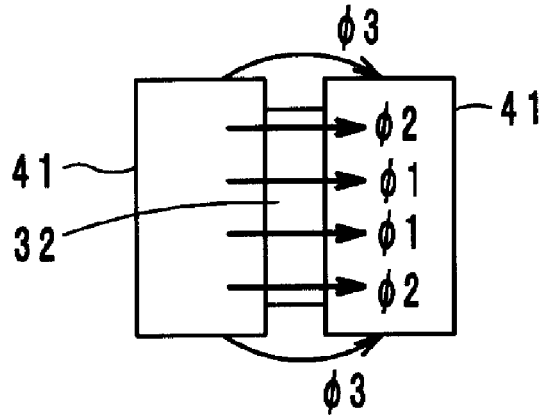
Figure 13C:
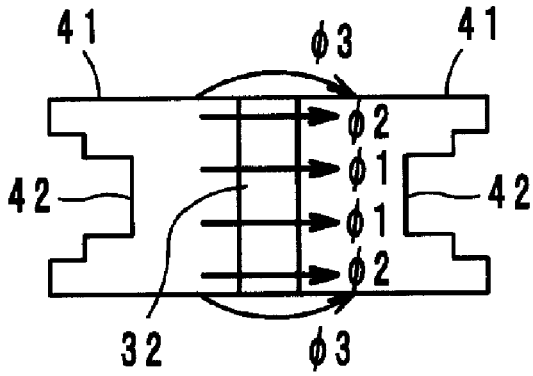

On the other hand, in the present preferred embodiment, since the top and bottom ends of the permanent magnets 41 are preferably formed so as to be relatively thick, as shown in FIG. 13C, large magnetic flux is produced at the top and bottom ends of the ferrite 32. Thus, even when the leakage flux $\phi 3$ occurs, the magnetic flux $\phi 2$ at the top and bottom ends equivalent to the magnetic flux $\phi 1$ at the center portion can be obtained. However, the magnetic field intensity at the both ends in the long side direction decreases due to magnetic flux leakage. The magnetic field distribution in the preferred embodiment corresponds to a model in which 25000 A/m, for example, is applied to the center portion including the top and bottom ends, and 20000 A/m, for example, is applied to the both ends in the long side direction, as shown in FIG. 7C. The insertion loss characteristics are as indicated by a dashed line C in FIG. 8 and are substantially the same as those in the case where a magnetic field of 25000 A/m, for example, is applied to the entire surfaces of the ferrite 32 (refer to the solid line A).

In the ferrite-magnet assembly 30 of this type, a high frequency field is concentrated in a direction (the short side direction of the ferrite 32) perpendicular or substantially perpendicular to a direction in which the second center electrode 36 is disposed in parallel or substantially in parallel. Thus, when an even direct current magnetic field having necessary intensity (for example, 25000 A/m) is not applied to the short side direction of the ferrite 32, the insertion loss characteristics deteriorate.

Figure 7B:
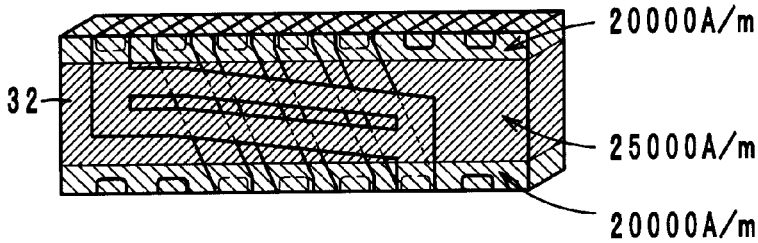
Figure 7C:
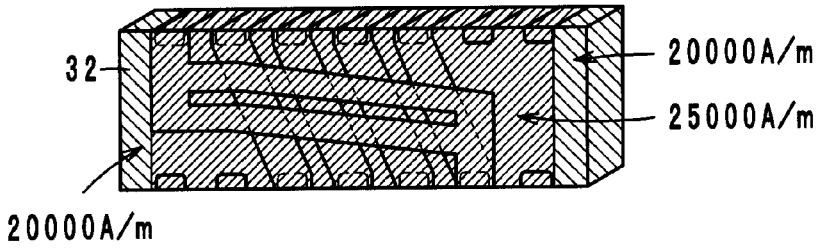
Figure 8:
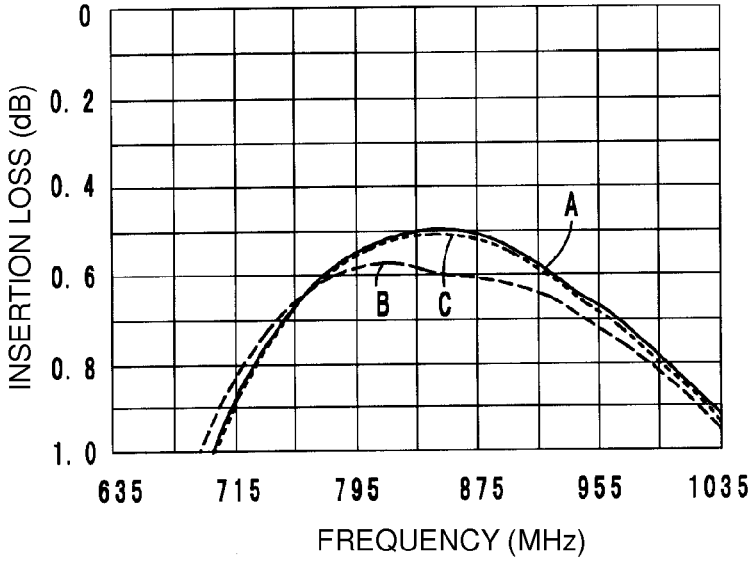
FIG. 8 is a graph showing insertion loss characteristics in the three types of models.

A decrease in magnetic flux that acts on the electrodes disposed at the top and bottom ends of the ferrite 32 is considered to be a cause of a deterioration in the insertion loss characteristics (refer to the known art, the long dash line B in FIG. 8) of a model shown in FIG. 7B. On the other hand, a small high frequency field at the both ends of the ferrite 32 in the long side direction, no electrode being provided in the both ends, is considered to be a cause of achieving the insertion loss characteristics (refer to the present preferred embodiment, the dashed line C in FIG. 8) of a model shown in FIG. 7C, which are just slightly degraded compared with the insertion loss characteristics (refer to an ideal example, the solid line A in FIG. 8) of a model shown in FIG. 7A. That is, a change in a direct current magnetic field at the both ends of the ferrite 32 in the long side direction has little influence on the characteristics of the isolator.

In the present preferred embodiment, a direct current magnetic field having an even density can be applied to a necessary portion of the ferrite 32. Thus, insertion loss characteristics substantially equivalent to those in the case shown in FIG. 13B can be achieved without an arrangement shown in FIG. 13B in which the height of the permanent magnets 41 is increased. Moreover, insertion loss that is improved compared with that in the known art shown in FIG. 13A can be achieved.

Figure 9A:
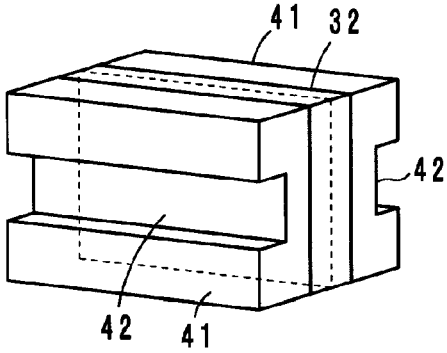
FIG. 9A is a perspective view of a model for showing magnetic flux density distribution in the ferrite in a preferred embodiment of the present invention.
Figure 9B:
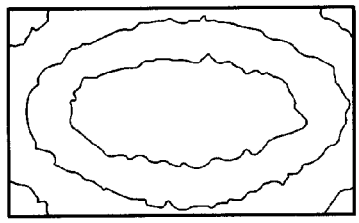
FIG. 9B is a chart showing density distribution.
Figure 10A:
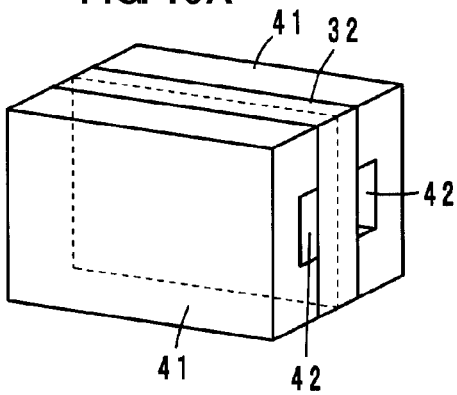
FIG. 10A is a perspective view of a model for showing magnetic flux density distribution in the ferrite in a comparative example.
Figure 10B:
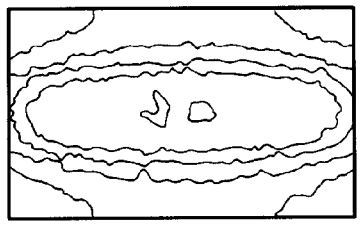
FIG. 10B is a chart showing density distribution.

Moreover, in the present preferred embodiment, as shown in FIG. 9A, the flat principal surface of each of the permanent magnets 41 is disposed so as to oppose a principal surface of the ferrite 32, and a surface on which the depression 42 is formed is disposed on the outside. FIG. 9B shows the magnetic flux density distribution in the ferrite 32 in such an arrangement. On the other hand, FIG. 10B shows the magnetic flux density distribution in the ferrite 32 in a case shown in FIG. 10A where the flat principal surface of each of the permanent magnets 41 is disposed on the outside, and a surface on which the depression 42 is formed is disposed so as to oppose a principal surface of the ferrite. FIGS. 9B and 10B each show the density distribution at the cross section of the center of the ferrite 32 indicated by a dotted line portion in a corresponding one of FIG. 9A and FIG. 10A.

When a surface of each of the permanent magnets 41 on which the depression 42 is formed is disposed so as to oppose a principal surface of the ferrite 32, since an airspace intervenes between the magnet and the ferrite, the magnetic flux density distribution is disturbed (refer to FIG. 10B). In contrast, when the flat principal surface of each of the permanent magnets 41 is disposed so as to oppose a principal surface of the ferrite 32, magnetic flux density distribution that is even compared with that shown in FIG. 10B is achieved (refer to FIG. 9B).

Moreover, in the present preferred embodiment, since the planar yoke 10 is disposed just above the ferrite-magnet assembly 30 with the dielectric layer 15 between the planar yoke 10 and the ferrite-magnet assembly 30, a known circular or boxy yoke of soft iron is unnecessary. Moreover, the planar yoke 10 can be readily manufactured and handled. Thus, the costs can be reduced as a whole. Moreover, since the yoke 10 is not mechanically joined to the circuit board 20, there is no damage to the circuit board 20 due to heat stress, and thus the reliability is improved.

Moreover, since no yoke that surrounds the ferrite-magnet assembly 30 exists, the size of the outer shape of the isolator can be reduced, or the size of the outer shape of the ferrite-magnet assembly 30 can be increased. Thus, the electric characteristics can be improved. In particular, when the first and second center electrodes 35 and 36 are enlarged, the inductance value, the Q value, and the like become large.

Moreover, since the ferrite 32 is integrated with the pair of the permanent magnets 41, using the adhesives 45, the ferrite-magnet assembly 30 is mechanically stable and constitutes a strong isolator that is not deformed or broken under vibrations, impact, and the like. Moreover, since, in the ferrite-magnet assembly 30, the principal surfaces 32*a* and 32*b* of the ferrite 32 are disposed perpendicular or substantially perpendicular to the circuit board 20, even when the thickness of the permanent magnets 41 is increased, a reduction in the profile of the isolator is not impaired.

In this isolator, the circuit board 20 is a multilayer dielectric board. Thus, a network including, for example, capacitors and resistors can be built in, and the size and thickness of the isolator can be reduced. Moreover, since connections between circuit elements are established within the board, an improvement in the reliability can be expected. Needless to say, the circuit board 20 need not necessarily be multilayer and may be single-layer. For example, chip-type matching capacitors may be adopted and may be externally attached.

Figure 11:
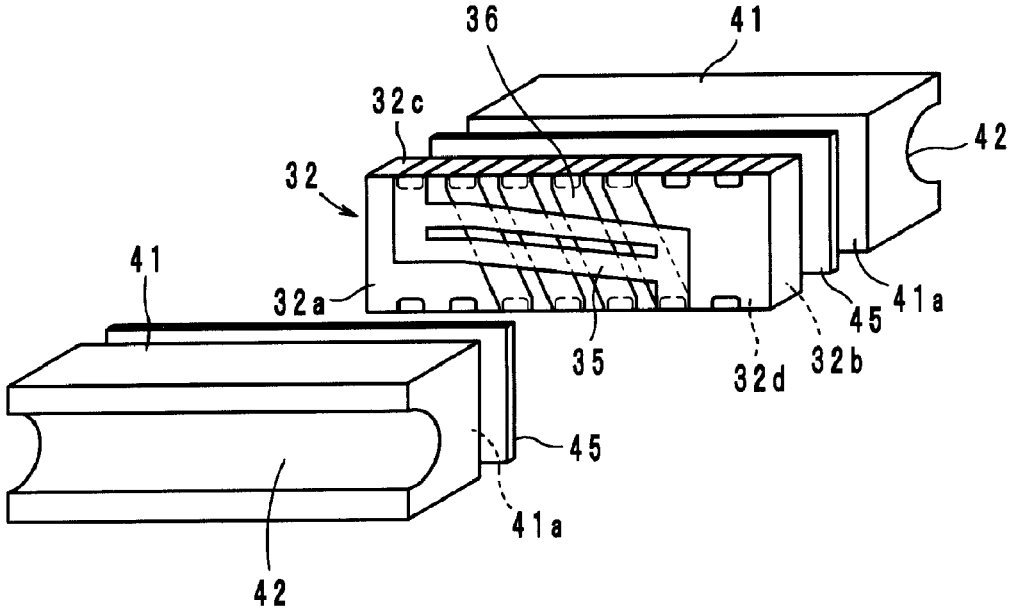
FIG. 11 is an exploded perspective view showing another pattern of a permanent magnet.
Figure 12:
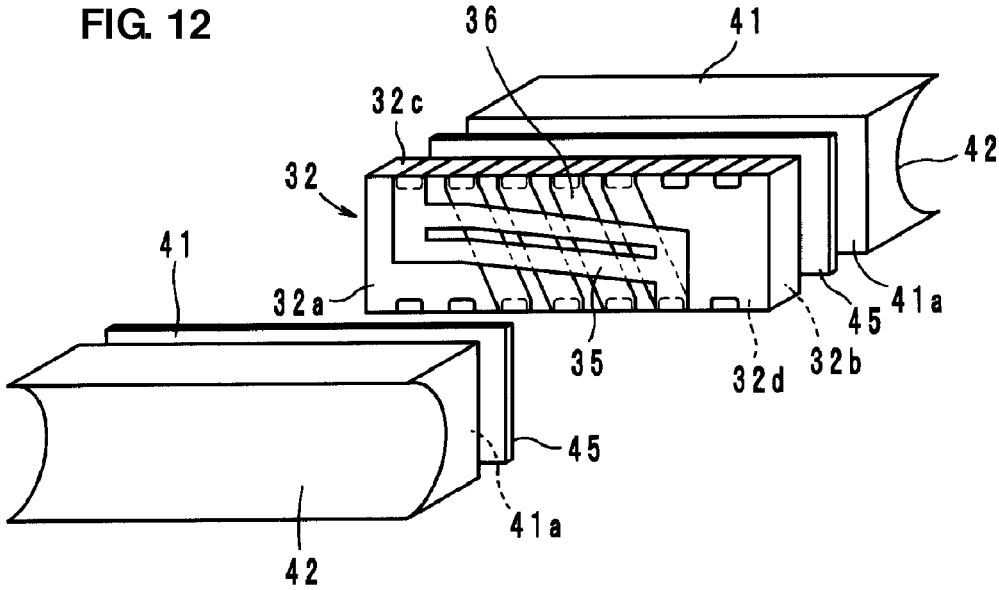
FIG. 12 is an exploded perspective view showing yet another pattern of a permanent magnet.

The cross section of the depression 42 may have various shapes other than a staircase shape. For example, the cross section may be semicircular, as shown in FIG. 11. Moreover, the shape of the cross section may be an arc that continuously changes from the top end to the bottom end, as shown in FIG. 12.

In the aforementioned nonreciprocal circuit device, it is preferable that the one end of the first center electrode be electrically connected to the input port, the other end of the first center electrode be electrically connected to the output port, the one end of the second center electrode be electrically connected to the output port, the other end of the second center electrode be electrically connected to the ground port, a first matching capacitor be electrically connected between the input port and the output port, a second matching capacitor be electrically connected between the output port and the ground port, and a resistor be electrically connected between the input port and the output port. In this arrangement, a lumped constant isolator of a two-port type in which insertion loss is small can be obtained.

Moreover, it is preferable that the first center electrode and the second center electrode be formed on the ferrite, using conductor films, the first center electrode and the second center electrode being electrically insulated from each other and intersecting with each other at predetermined angles. This is because the first center electrode and the second center electrode can be precisely and stably formed, using a thin film forming technique such as photolithography, for example.

Moreover, in the ferrite-magnet assembly, the principal surfaces of the ferrite may be disposed perpendicular or substantially perpendicular to the surface of the circuit board where the terminal electrodes are formed. Alternatively, the planar yoke may be disposed above the top surface of the ferrite-magnet assembly with the dielectric layer between the planar yoke and the ferrite-magnet assembly. In this arrangement, the size of the nonreciprocal circuit device can be reduced, and strong coupling between the first and second center electrodes can be achieved by increasing the thickness of the permanent magnet.

Moreover, it is preferable that the permanent magnet include a flat principal surface and a surface on which the thickness changes, and that the flat principal surface is disposed so as to oppose a principal surface of the ferrite. In this arrangement in which the flat principal surface of the permanent magnet opposes the principal surface of the ferrite, the distribution of density of magnetic flux applied to the ferrite is made uniform.

It is preferable that the pair of the permanent magnets sandwiching the ferrite form a symmetric shape with the ferrite being its center. The thickness of the permanent magnets may change so that the cross-sectional shape is a staircase shape or an arc shape.

The nonreciprocal circuit device according to the present invention is not limited to the aforementioned preferred embodiment and may be modified in various forms within the sprit of the present invention.

For example, when the north and south poles of the permanent magnets 41 are inverted, the input port P1 and the output port P2 are interchanged with each other. Moreover, the shape of the first and second center electrodes 35 and 36 can be changed in various forms. For example, while the first center electrode 35, which is preferably bifurcated into two parts on the principal surfaces 32*a* and 32*b* of the ferrite 32, has been described in the aforementioned preferred embodiment, the first center electrode 35 may not be bifurcated into two parts. Moreover, at least one turn of the second center electrode 36 needs to be wound.

Moreover, while the pair of the right and left permanent magnets 41, in each of which the depression 42 is preferably provided, has been described in the aforementioned preferred embodiment, the depression 42 may be formed only in one of the permanent magnets 41. The plurality of the relay electrodes provided on the top surface 32*c* and the bottom surface 32*d* of the ferrite 32 need not be formed in the depressions 37 shown in FIG. 3 and may be formed on the top surface 32*c* and the bottom surface 32*d*, which are flat, using conductor films.

As described above, various preferred embodiments of the present invention are useful for nonreciprocal circuit devices such as isolators and circulators, and in particular, are excellent in that a direct current magnetic field having an even density can be applied to a necessary portion of a ferrite without impairing a reduction in profile, and thus insertion loss can be improved.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A nonreciprocal circuit device comprising:

permanent magnets;

a ferrite having a substantially rectangular parallelepiped plate shape including two principal surfaces opposite each other, the ferrite being arranged such that the permanent magnets apply a direct current magnetic field that penetrates the two principal surfaces of the ferrite; and a first center electrode and a second center electrode disposed on the ferrite, the first center electrode and the second center electrode being electrically insulated from each other and intersecting with each other; wherein the ferrite and the permanent magnets constitute a ferrite-magnet assembly in which the permanent magnets are disposed so as to oppose the principal surfaces of the ferrite;

the first center electrode and the second center electrode are disposed on the principal surfaces of the ferrite and are wound around the ferrite via relay electrodes provided on side surfaces disposed on long sides, the side surfaces being perpendicular or substantially perpendicular to the principal surfaces; and each of the permanent magnets includes a principal surface that has the same shape as the principal surfaces of the ferrite, and portions of the permanent magnet opposing the relay electrodes are thicker than other portions thereof.

2. The nonreciprocal circuit device according to claim 1, wherein one end of the first center electrode is electrically connected to an input port, the other end of the first center electrode is electrically connected to an output port, one end of the second center electrode is electrically connected to the output port, the other end of the second center electrode is electrically connected to a ground port, a first matching capacitor is electrically connected between the input port and the output port, a second matching capacitor is electrically connected between the output port and the ground port, and a resistor is electrically connected between the input port and the output port.

3. The nonreciprocal circuit device according to claim 1, wherein the first center electrode and the second center electrode are disposed on the ferrite and include conductor films, the first center electrode and the second center electrode being electrically insulated from each other and intersecting with each other at predetermined angles.

4. The nonreciprocal circuit device according to claim 1, wherein, in the ferrite-magnet assembly, the principal surfaces of the ferrite are disposed perpendicular or substantially perpendicular to a surface of a circuit board, and terminal electrodes are disposed on a surface of the circuit board.

5. The nonreciprocal circuit device according to claim 1, wherein a planar yoke is disposed above a top surface of the ferrite-magnet assembly with a dielectric layer between the planar yoke and the ferrite-magnet assembly.

6. The nonreciprocal circuit device according to claim 1, wherein the permanent magnet includes a flat principal surface and a surface on which thickness changes, and the flat principal surface is disposed so as to oppose a corresponding one of the principal surfaces of the ferrite.

7. The nonreciprocal circuit device according to claim 1, wherein a thickness of the permanent magnet changes so that a cross-sectional shape is a staircase shape.

8. The nonreciprocal circuit device according to claim 1, wherein a thickness of the permanent magnet changes so that a cross-sectional shape is an arc shape.

9. The nonreciprocal circuit device according to claim 1, wherein a pair of the permanent magnets sandwiching the ferrite defines a symmetrical configuration with the ferrite being a center of the symmetrical shape.

* * * * *